United States Patent [19]

Worthington

[11] Patent Number: 4,984,433

[45] Date of Patent: Jan. 15, 1991

[54] AIR CONDITIONING APPARATUS HAVING VARIABLE SENSIBLE HEAT RATIO

[76] Inventor: Donald J. Worthington, 3440 Eastlake Rd., #114, Palm Harbor, Fla. 33563

[21] Appl. No.: 412,683

[22] Filed: Sep. 26, 1989

[51] Int. Cl.[5] ..... F25B 41/04; F25D 17/06

[52] U.S. Cl. ..... 62/90; 62/176.5; 62/176.6; 62/181; 62/196.4

[58] Field of Search ..... 62/176.6, 176.5, 176.1, 62/173, 90, 180, 181, 186, 196.4

[56] References Cited

U.S. PATENT DOCUMENTS

| | | | |
|---|---|---|---|
| 1,986,863 | 1/1935 | Terry | 62/173 |
| 2,257,916 | 10/1941 | Poythress | 62/176.5 X |
| 2,293,532 | 8/1942 | Crane | 62/176.5 X |
| 2,975,609 | 3/1961 | Allander et al. | 62/173 X |
| 3,402,564 | 9/1968 | Nussbaum | 62/173 |
| 4,350,023 | 9/1982 | Kuwabara et al. | 62/176.6 |
| 4,873,649 | 10/1989 | Grald et al. | 62/176.6 X |

*Primary Examiner*—Harry B. Tanner

*Attorney, Agent, or Firm*—Joseph C. Mason; Ronald E. Mason

[57] ABSTRACT

An air conditioning system with a variable sensible heat ratio. The system includes a servomechanism that monitors the sensible and latent heat in the air being conditioned and adjusts the operation of the system accordingly. A microprocessor calculates the respective rates of change in sensible and latent heat and adjusts the operation of the system so that the desired amount of sensible and latent heat is removed at the same time, thereby conserving energy. The system includes a variable speed supply air fan and a plurality of subcooling coils. Under a first set of conditions, the fan is slowed down and the subcooling of the refrigerant fluid is increased. Under a second set of conditions, the fan is sped up and the subcooling is decreased.

15 Claims, 2 Drawing Sheets

AIR CONDITIONING APPARATUS HAVING VARIABLE SENSIBLE HEAT RATIO

Technical Field

This invention relates, generally, to the field of air conditioners. More particularly, it relates to an improved air conditioning system that senses the sensible and latent heat in a space and adjusts its operation to reach a targeted ratio therebetween in a manner that conserves electrical power.

Background Art

When a space is air conditioned, both the dry bulb temperature and the moisture content of the air in the space are lowered.

The art defines the total heat of a space as the sum of the sensible heat and the latent heat. The former relates to dry bulb temperature and the latter relates to the moisture content of the air in the space.

In a space having undesirably high amounts of moisture in the air, large amounts of electrical power may be consumed as a conventional air conditioning system labors to remove such moisture. As a result of the work performed by the system as it removes the moisture, the dry bulb temperature of the space may be brought down to a level that is unacceptably cool to the occupants of the space.

Conversely, when a space having a high dry bulb temperature but relatively low humidity is air conditioned, the humidity may be unacceptably or unnecessarily low by the time the dry bulb temperature is brought down to its desired level.

Thus, the air conditioning engineer is in a quandary because the successful removal of latent heat may entail an overly successfully removal of sensible heat, and vice versa.

Efforts must then be made to cure the unacceptable condition and such efforts necessarily adversely affect energy consumption.

The conventional solution to the quandary has been to design air conditioning systems that pursue both goals—the lowering of dry bulb temperature and moisture content—in an equally inefficient manner. High efficiency in reducing sensible heat is traded off for efficiency in removing latent heat and vice versa.

This trade off produces some very undesirable consequences. Perhaps the worst situation caused by the compromise is where the dry bulb temperature is reduced to an unacceptably low level because the system is continuing to labor to reduce the moisture content; the conventional solution to this problem has been to inject warm air into the space to avoid excessive depression of the dry bulb temperature so that the dehumidifying work can continue. This, obviously, is an egregious waste of energy.

The ratio of sensible heat to total heat is known as the sensible heat ratio. In most air conditioned buildings, the sensible heat ratio of the air therein will vary from about 0.60 to about 0.90, depending upon the time of year, time of day, and a multitude of other factors. A sensible heat ratio of 0.60 indicates that, of the total heat in the space, sixty percent of it is attributable to the dry bulb temperature of the space and forty percent is attributable to the moisture content of the air. Thus, a sensible heat ratio of 0.90 indicates that only ten percent of the total heat is latent heat. In the former situation, the dry bulb temperature in the space could be unacceptably low by the time the desired amount of latent heat is removed from the space. In the latter situation, the humidity in the space could be unacceptably low by the time the required amount of sensible heat is removed.

Accordingly, most air conditioning systems are designed are designed to work most efficiently in a space where the sensible heat ratio is about 0.75, i.e., when the total heat in a space is about three-fourths sensible heat and one-fourth latent heat. Since the space will seldom be at that particular ratio, energy is wasted whenever the system is conditioning a space that in reality has a different sensible heat ratio.

Several inventors have recognized the inefficiencies inherent in fixed sensible heat ratio air conditioning systems and have developed systems that adjust the sensible heat ratio to accommodate different sensible heat ratios in the space being conditioned. Examples of such systems are shown in Japanese patent Nos. 57-144835 and 62-237240. Moreover, U.S. Pat. No. 2,195,781 to Newton discloses a humidity sensitive air conditioner having the ability to switch between more or less latent and/or sensible heat capacity operation by the use of cooling coils that selectively heat and/or cool the air to be conditioned. Similarly, U.S. Pat. No. 4,003,729 to McGrath shows an air conditioner that employs fan speed controls. Ashley et. al. U.S. Pat. No. 2,218,597 is additionally of interest for its disclosure of several fans and a sub-cooler as is Freemann U.S. Pat. No. 4,271,898 for its disclosure of a multiple speed fan for controlling relative humidity. U.S. Pat. No. 3,119,239 to Sylvan and U.S. Pat. No. 1,956,707 to Carrier disclose variable area cooling coils and air controls. Logan U.S. Pat. No. 4,512,161 is also of interest for its disclosure of a dew point sensitive computer controlled cooling system. Additional U.S. Patents of interest include U.S. Pat. Nos. 2,093,725, 2,162,860, 2,451,385, 4,018,584, 4,182,133, 4,350,023, 4,428,205 and 4,448,597.

Disclosure of Invention

The air conditioning system of the present invention is a servomechanism because it monitors the sensible heat ratio of the space being serviced and adjusts its operation accordingly.

A first sensor monitors the dry bulb temperature of the air in the space and a second sensor monitors the moisture content of that air. The dry bulb temperature and the moisture content of the air are electrically reported to a microprocessor that evaluates such data and issues commands to the system that adjusts the configuration of the system to efficiently achieve the desired sensible heat ratio of the space. In this manner, the output of the system is changed based upon the condition of the air being treated and energy requirements are thereby minimized. Importantly, the microprocessor balances the system so that a targeted removal of sensible heat is not overshot while the targeted removal of latent heat is being pursued, and vice versa.

In other words, the microprocessor governs the operation of the system so that it achieves its targeted level of sensible heat at the same time it achieves its targeted level of latent heat. Thus, the system lets sensible heat removal lag behind latent heat removal when the sensible heat ratio is low, and, conversely, the system lets sensible heat removal lead latent heat removal when the sensible heat ratio is high. The desired levels of temperature and humidity in the space are thus achieved substantially simultaneously. This eliminates the need for energy-squandering injections of heat or humidity into the space and minimizes electrical consumption.

The microprocessor controls two elements of the novel system: a variable speed supply air fan and a liquid subcooler having variable heat transfer capacity. When it is desired to remove more latent heat than sensible heat, a command indicating said desire is emitted from the microprocessor, and the supply air fan is slowed down so that air flows over the evaporator coils slowly. Thus, the air experiences prolonged contact with the evaporator coils and more moisture is condensed therefrom than would occur if the air flow were faster. Moreover, since less cool air is supplied to the space, the cooling effect that it has on the space being conditioned is reduced. Conversely, when the sensible heat ratio is high and the first goal of the system is to reduce the sensible heat, the microprocessor, upon receiving this information from the space sensors, speeds up the supply air fan, thereby driving air over the coils at a faster rate. This reduces the dehumidification effect, but speeds the cooling of the space.

The novel system also includes still another means for responding to differing conditions in the space being conditioned. This additional means is provided in two different embodiments, but both embodiments include at least one row of subcooling coils disposed in the path of air leaving the evaporator coils. Accordingly, the refrigerant in the subcooling coils is cooled by an additional amount and the overall efficiency of the system is thereby increased since the efficiency of any heat engine increases as the temperature differences between its highest and coolest points increases. More particularly, for each one degree Fahrenheit decrease in the temperature of the refrigerant fluid, the total evaporator capacity is increased by one-half percent (0.5%). Moreover, the subcooling coils subtract back the sensible advantage gained, but do not take away the latent advantage.

In a first embodiment, a plurality of subcooling coils are placed in the path of the air flowing over the evaporator coils, as aforesaid, and each coil is individually valved so that it can be placed into or taken out of the system, in effect, dependent upon information about the air conditioned space supplied to the microprocessor by the sensors. A bypass route is also provided so that all of the subcooling coils can be taken out of the system, in effect, when conditions call for that. Thus, all of the subcooling coils may be placed into service, all of them may be taken out, or any number of said subcooling coils may be employed between those two extremes as conditions warrant.

When the subcooling coils are bypassed, the circulating refrigerant flows to the expansion valve as in conventional systems without subcooling. The microprocessor will command the valves of all of the subcooling coils to close so that all of the refrigerant bypasses such coils when the humidity in the space is falling at a rate greater than the dry bulb temperature. Concurrently, the microprocessor will command the supply air fan to speed up, thereby moving the air over the evaporator coils more quickly to decrease the amount of dehumidification and to increase the volume of cool air flowing into the space. Thus, a decrease in the number of subcooling coils through which refrigerant accentuates the effect of an increase in supply air fan speed.

When the space monitors report to the microprocessor that the temperature in the space is dropping at a rate greater than the rate of dehumidification, the microprocessor will command the appropriate number of valves to open to obtain the desired amount of subcooling of refrigerant. For example, in an extreme situation, all of the subcooling coils would be opened and the supply air fan speed would be minimized to deal with latent heat removal that is substantially lagging behind sensible heat removal.

In an alternative configuration of the subcooling coils, the individual valves for each coil are obviated. Instead, rotatably mounted damper members are employed to control the rate of flow of air from the evaporator coils over the subcooling coils. Thus, when monitored conditions call for maximum subcooling, the dampers fully open and when no subcooling is called for, the dampers close and the air from the evaporator coils bypasses the subcooling coils and goes directly to the space being cooled. Any condition between those two extremes is handled by intermediate positions of the damper members, under the control of the microprocessor.

It is therefore clear that the primary object of this invention is to provide an air conditioning system that conserves electrical power by monitoring the sensible heat ratio of a space being air conditioned and controlling the internal operation of the air conditioning system accordingly.

The invention accordingly comprises the features of construction, combination of elements and arrangement of parts that will be exemplified in the construction set forth hereinafter and the scope of the invention will be set forth in the claims.

Description of the Drawings

For a fuller understanding of the nature and objects of the invention, reference should be made to the following detailed description, taken in connection with the accompanying drawings, in which.

Similar reference numerals refer to similar parts throughout the several views of the drawings.

Best Modes for Carrying Out the Invention

Figure 1:
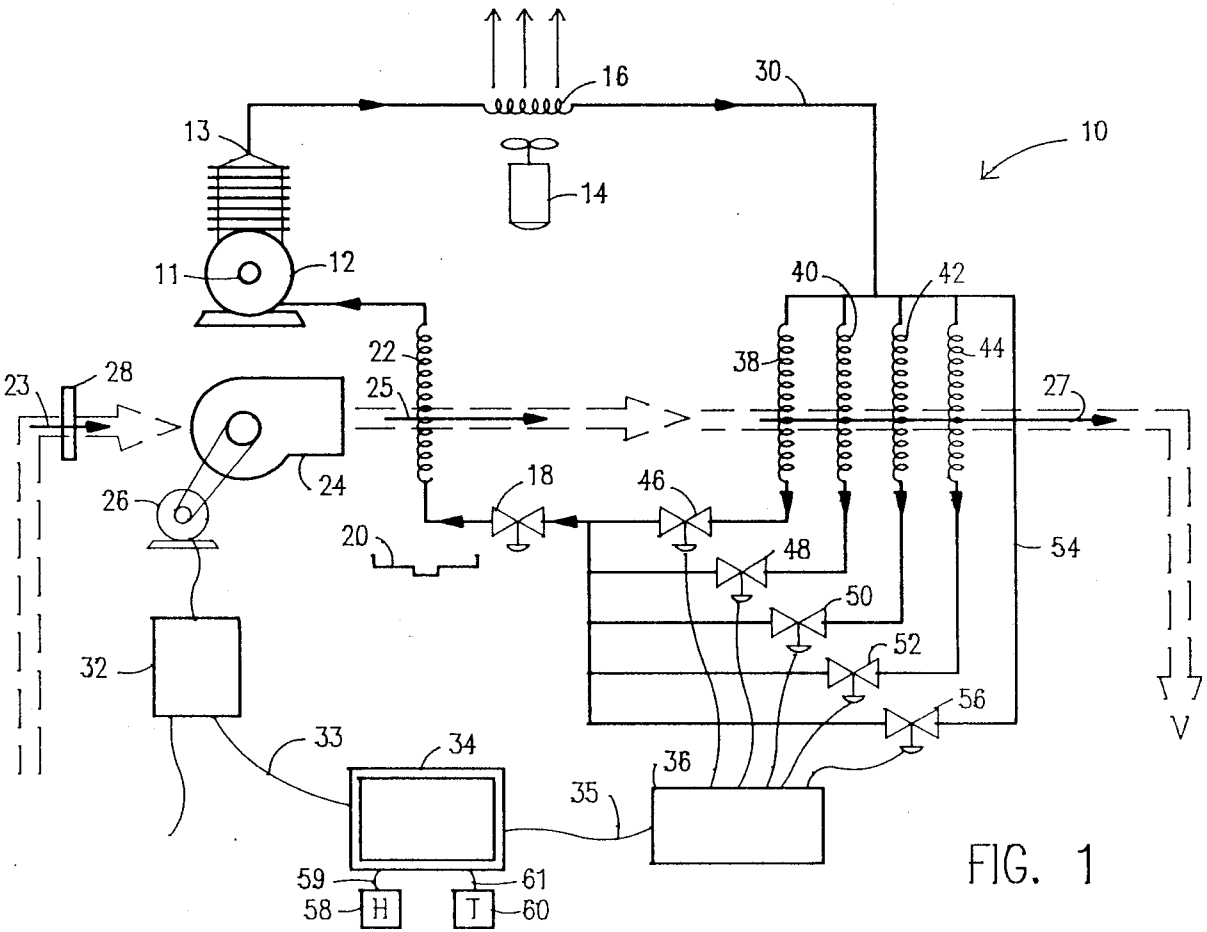
FIG. 1 is schematic diagram of a first embodiment of the novel air conditioning system.

Referring now to FIG. 1, it will there be seen that a first illustrative embodiment of the present invention is denoted as a whole by the reference numeral 10.

The conventional parts of the system 10 include compressor 12 having low pressure inlet 11 and high pressure outlet 13, fan 14, condenser coils 16, expansion valve 18, condensate pan 20, evaporator coils 22, supply air fan 24, fan motor 26, and air filter 28 for the return air. The refrigerant fluid circulates through line 30. As indicated by directional arrow 23, return air is filtered by said filter 28, and as indicated by directional arrow 25, the return air is then blown over coils 22 by fan 24 and into the space being conditioned.

The parts that are not conventional and which collectively make up the novel system include an inverter type motor speed control 32 (also known as an adjustable frequency controller), the microprocessor 34, the step controller 36, subcooling coils 38, 40, 42 and 44, electric valves 46, 48, 50, 52 associated with said subcooling coils, respectively, bypass refrigerant line 54, valve 56 associated with said bypass line 54, and sensors 58, 60.

Return air that has already passed over evaporator coils 22 as indicated by directional arrow 25 as aforesaid, also flows over the subcooling coils as indicated by directional arrow 27.

Sensor 58 is positioned in the space being cooled and monitors the moisture content (relative humidity) of the air therein. Sensor 60, similarly positioned, monitors the dry bulb temperature of that air.

Sensors 58, 60 periodically send data to microprocessor 34 over cables 59, 61, respectively. A memory means, not shown, in the microprocessor 34, stores the data and a comparator means, not shown, compares incoming data to earlier data and calculates the difference in the values of the humidity and temperature over time to determine the rate at which each of said monitored conditions is changing. If these devices determine from the incoming data that humidity and temperature are dropping at rates where the desired level of each will be reached substantially simultaneously, then the status quo of the system is simply maintained by the microprocessor 34. However, when the falling rates are such that the microprocessor determines that the desired level of said conditions will not be reached at the same time, the microprocessor 34 adjusts the system accordingly. For example, where humidity is dropping at a rate that is too fast, microprocessor 34 sends signals over cables 33 and 35 to adjustable frequency device 32 and step controller 36, respectively, to speed up fan motor 26 and to appropriately decrease the number of subcooling coils 38, 40, 42 and 44 through which refrigerant fluid flows by shutting off the appropriate number of valves 46, 48, 50, 52. As mentioned earlier, the increased volume flow of air over evaporator coils 22 will retard the rate of dehumidification and increase the rate of sensible temperature decrease. Conversely, when the sensible heat is being removed at a rate that is too fast, relative to the rate of latent heat removal, microprocessor 34 signals the fan motor 26 to slow down and causes additional subcooling valves to open.

Four subcooling coils are shown in FIG. 1, but empirical tests could determine that a different number of coils is optimal. For example, preliminary studies have shown that in some installations a single subcooling coil is the only coil needed to produce the desired effects when brought into or taken out of the system 10.

Figure 2:
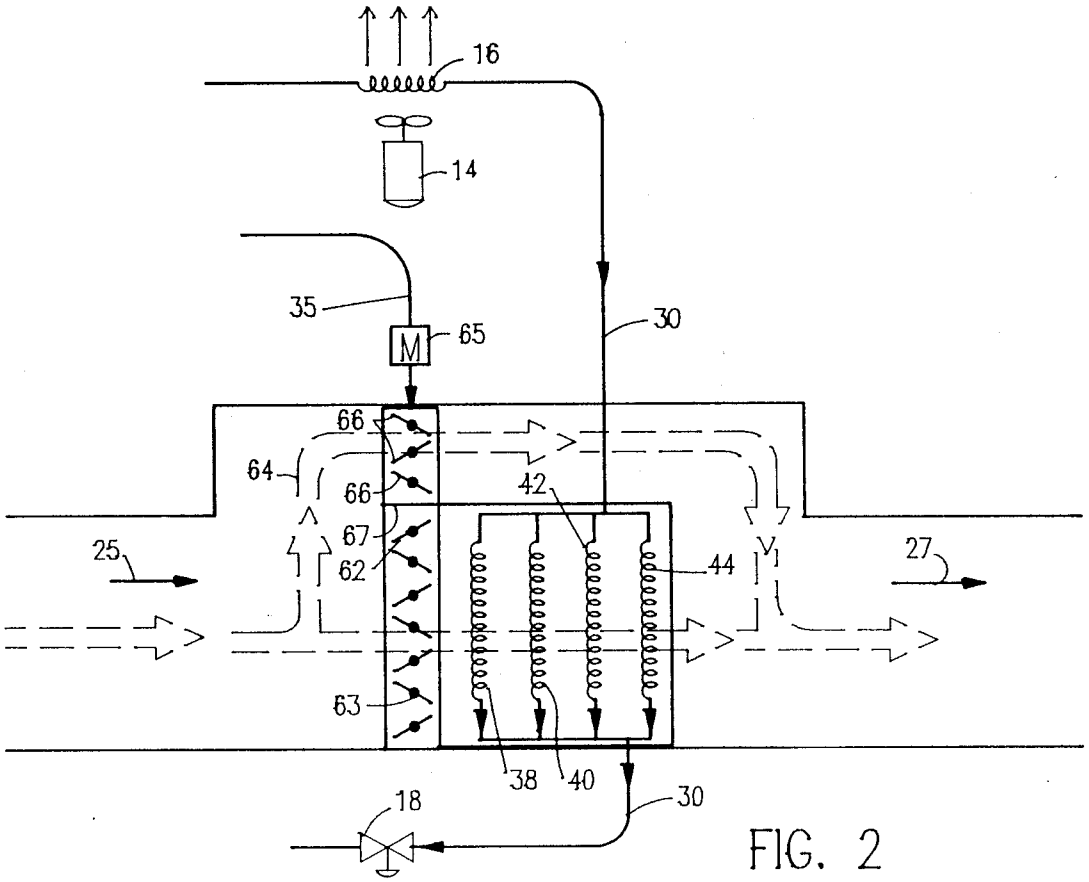
FIG. 2 is a schematic diagram of an alternative embodiment of the subcooling coils of this invention.

Valves 46, 48, 50 and 52 are obviated in the alternative embodiment of the subcooling coils shown in FIG. 2. Four subcooling coils are again depicted but the number could vary as aforesaid. A plurality of rotatably mounted face damper members, collectively denoted 62, are positioned in the path of travel of air that has passed through the evaporator coils 22, as indicated by directional arrow 25. When an extremely humid space is to be conditioned, supply air fan motor 24 is slowed down by the microprocessor 34 and the face dampers 62 are rotated by modulating motor 65 about their respective pivot points, collectively denoted 63, until they are disposed parallel to the flow of air therethrough, i.e., in parallelism to directional arrow 25. This orientation of damper members 62 allows maximum air flow over the subcooling coils and corresponds to the configuration of the FIG. 1 system when all electric valves 46, 48, 50 and 52 are open to bring all four subcooling coils into the system.

In the reverse extreme situation where sensible heat is to be removed at a much faster rate than latent heat, fan motor 26 is sped up to its maximum speed by microprocessor 34 and all of the face dampers 62 are closed, i.e., rotated until they are orthogonally disposed to directional arrow 25. Bypass dampers 66 in the bypass duct 64 would then open and the subcooling coils would be effectively removed from the system.

The face dampers 62 operate in the reverse of the bypass dampers 66, i.e., the face dampers 62 close as the bypass dampers 66 opens, thus routing the air from one path to the other. A suitable mechanical linkage, not shown, is employed to tie said face and bypass dampers together. The reference numeral 67 indicates a partition that segregates the face damper section from the bypass damper section.

Thus, any angular configuration of the dampers 63 between their fully open and fully closed position results in a change in the rate of dehumidification and cooling. This alternative embodiment, therefore, provides even more fine tuning control over system 10 than the subcooling coils under the control of the step controller.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An air conditioning system including a compressor means and an evaporator means, comprising:

sensible heat sensing means disposed in sensing relation to return air from a space being air conditioned;

latent heat sensing means disposed in sensing relation to said return air;

a microprocessor means having a first input means that receives data from said sensible heat sensing means and a second input means that receives data from said latent heat sensing means;

a supply air fan;

a variable speed motor means disposed in driving relation to said supply air fan;

said microprocessor means having a first output means conductively coupled to said variable speed motor means;

a memory means being included in said microprocessor means;

said sensible and latent heat sensing means being operative to periodically supply data to said memory means;

a comparator means being including in said microprocessor means;

said memory means and said comparator means being conductively coupled to one another;

said comparator means being operative to compare incoming data from said respective sensing means and earlier data from said memory means and being further operative to periodically determine a rate of change in the difference between latent heat and sensible heat as sensed by said respective sensing means;

subcooling means for reducing the temperature of refrigerant fluid circulating in said air conditioning system prior to the entry of said refrigerant fluid into an expansion valve of said air conditioning system;

said subcooling means being positioned on a cool side of said evaporator means;

means for varying the amount of said subcooling;

said microprocessor means having a second output means conductively coupled to said means for varying the amount of said subcooling;

said microprocessor means being programmed to adjust the speed of said variable speed motor means and said means for varying the amount of said subcooling in response to input data supplied by said comparator means.

2. The system of claim 1, wherein said subcooling means includes at least one subcooling coil disposed in the path of circulating air that has circulated over evaporator coils of said system.

3. The system of claim 2, further comprising:

a bypass means that bypasses said at least one subcooling coil;

said microprocessor means having a third output means conductively coupled to said bypass means;

said microprocessor means being programmed to direct refrigerant fluid through said bypass means in response to input data supplied by said sensible heat sensing means; and said microprocessor means being programmed to direct refrigerant fluid through said at least one subcooling coil in response to input data supplied by said comparator means.

4. The system of claim 3, wherein said means for varying the amount of subcooling includes a first valve means disposed in serial relation to said at least one subcooling coil means and a second valve means disposed in serial relation to said bypass means, said first and second valve means being disposed in controlled relation to said microprocessor means.

5. The system of claim 4, further comprising a step controller means disposed in electrically interconnecting relation between said microprocessor third output means and said first and second valve means.

6. The system of claim 1, wherein said means for varying the amount of subcooling includes at least one subcooling coil disposed in the airflow of air that has just passed over evaporator coils of said system, a movably mounted face damper means disposed between said evaporator coils and said at least one subcooling coil, and a face damper bypass means disposed between said evaporator coils and said face damper means, said face damper means being adapted to close when said face damper bypass means opens, and said face damper means being adapted to open when said face damper bypass means closes.

7. The system of claim 6, wherein said face damper means includes a plurality of imperforate pivotally mounted wall members and further comprises a motor means for changing the angular orientation of said wall members with respect to a path of travel of air flowing over said evaporator coils and said at least one subcooling coil.

8. An air conditioning system, comprising:

an compressor means having an inlet and an outlet;

an expansion valve means;

an evaporator coil means;

a fluid passageway means interconnecting said compressor means, said expansion valve means and said evaporator coil means in a closed loop;

a refrigerant fluid that circulates in said fluid passageway means;

a supply air fan disposed in open communication with said evaporator coil means so that return air from a space being conditioned is moved by said supply air fan over said evaporator coil means;

a motor means disposed in driving relation to said supply air fan;

speed control means for selectively varying the speed of said motor means;

at least one subcooling coil disposed in fluid communication with said fluid passageway means;

said at least one subcooling coil being disposed between a return air inlet and an supply air outlet on a cool side of said evaporator coil means so that air flowing over said evaporator coil means subsequently flows over said at least one subcooling coil means;

a bypass refrigerant line disposed in bypassing relation to said at least one subcooling coil;

a first valve means disposed in fluid communication with said at least one subcooling coil;

a bypass valve means disposed in fluid communication with said bypass refrigerant line;

a controller means having an input means and an output means;

said output means of said controller means being conductively coupled to said speed control means and said valve means;

a latent heat sensor means positioned in a space being conditioned;

a sensible heat sensor means positioned in a space being conditioned;

said latent heat and sensible heat sensor means being conductively coupled to said input means of said controller means;

whereby said controller means selectively controls said speed control means, said first valve means and said bypass valve means in accordance with information supplied to said controller means by said latent heat and sensible heat input means.

9. The system of claim 8, further comprising:

at least a second subcooling coil disposed in contiguous relation to said at least one subcooling coil;

a second valve means in fluid communication with said second subcooling coil;

said respective subcooling coils being disposed in parallelism to one another so that refrigerant fluid flows through each of them when their respective valve means are open; and said output means of said controller means being conductively coupled to said first and second valve means and to said bypass valve means to selectively control the flow of refrigerant fluid in accordance with data supplied to said controller means by said respective sensor means.

10. The system of claim 9, further comprising a step controller means conductively coupled to said respective valve means and wherein said step controller means is conductively coupled to an output means of said controller means so that opening and closing of said respective valve means is under the ultimate control of said controller means.

11. In an air conditioning system having a compressor means and an evaporator means, comprising:

a microprocessor means having first and second inputs and first and second outputs;

said first input being a humidity sensor positioned in a space being conditioned;

said second input being a temperature sensor positioned in said space;

a memory means forming a part of said microprocessor means;

a comparator means forming a part of said microprocessor means and being conductively coupled to said memory means;

said comparator means being operative to compare incoming data from said respective sensing means and earlier data from said memory means and being further operative to periodically determine a rate of change in the difference between latent heat and sensible heat as sensed by said respective sensors;

a speed control means for varying the speed of a supply air fan;

a subcooling coil means disposed in an airflow path between a return air inlet and a supply air outlet;

said subcooling coil means being positioned downstream of said evaporator means;

a subcooling coil valve means serially connected to said subcooling means;

means for bypassing said subcooling coil means;

a bypass valve means serially connected to said means for bypassing said subcooling coil means;

said first output of said microprocessor means being electrically connected to said speed control means;

said second output of said microprocessor means being electrically connected to said subcooling coil valve means and said bypass valve means;

said microprocessor means adjusting said speed control means and selectively controlling said subcooling coil valve means and bypass valve means in response to data supplied to it by said comparator means.

12. The system of claim 11, further comprising:

a step controller means;

said step controller means having an input and first and second outputs;

said step controller means input being electrically connected to said second output of said microprocessor means;

said first step controller output being electrically connected to said subcooling coil valve means; and said second step controller output being electrically connected to said bypass valve means.

13. In an air conditioning system, comprising:

a microprocessor means having first and second inputs and first and second outputs;

said first input being conductively coupled to a relative humidity sensor positioned in a space being conditioned;

said second input being conductively coupled to a dry bulb temperature sensor positioned in said space;

said microprocessor means including a memory means and a comparator means that are conductively coupled to one another;

said comparator means being operative to compare incoming data from said respective sensors and earlier data from said memory means and being further operative to periodically determine a rate of change in the difference between latent heat and sensible heat as sensed by said respective sensors;

a speed control means for varying the speed of a supply air fan;

a subcooling coil means disposed in an airflow path between a return air inlet and a supply air outlet in downstream relation to an evaporator coil of said system;

a pivotally mounted, imperforate face damper means disposed between said evaporator coil and said subcooling coil means;

a motor means disposed in driving relation to said face damper means, said motor means operative to change the angular orientation of said face damper means relative to a path of travel of air traveling over said evaporator coil and said subcooling means;

said microprocessor means being disposed in driving relation to said motor means and being operative to control the operation of said motor means to thereby control said angular orientation of said face damper means in response to information input into said microprocessor means by said comparator means.

14. The system of claim 13, further comprising:

said face damper means is closed;

a rotatably mounted bypass damper means;

a motor means disposed in driving relation to said bypass damper means, said motor means being operative to change the angular orientation of said bypass damper means relative to a path of travel of return air flowing therethrough;

said microprocessor means being disposed in driving relation to said motor means and being operative to control the operation of said motor means to thereby control said angular orientation of said bypass damper means in response to information input into said microprocessor means by said humidity and temperature sensors.

15. A method of efficiently removing sensible heat and latent heat from being air conditioned, comprising the steps of:

monitoring the sensible heat of said air with a first sensor means;

monitoring the latent heat of said air with a second sensor means;

calculating a first rate of change in sensible heat as an air conditioning means operates;

calculating a second rate of change in latent heat as said air conditioning means operates;

maintaining constant the rate of flow of return air over evaporator coils of an air conditioning means if said first and second rates are substantially equal;

increasing the rate of flow of return air over said evaporator coils if said second rate exceeds said first rate;

decreasing the rate of flow of return air over said evaporator coils if said first rate exceeds said second rate; and subcooling said refrigerant fluid if said first rate exceeds said second rate and accomplishing said subcooling by positioning a subcooling means downstream of said evaporator coils.

* * * * *